United States Patent [19]

Burns et al.

[11] 4,269,140

[45] May 26, 1981

[54] APPARATUS FOR POSITIONING A COATING THICKNESS CONTROL ROLLER IN A WEB COATING MACHINE

[75] Inventors: James W. Burns, Edmond; John J. Shelton, Tuttle, both of Okla.

[73] Assignee: Fife Corporation, Oklahoma City, Okla.

[21] Appl. No.: 60,652

[22] Filed: Jul. 25, 1979

[51] Int. Cl.[3] ..... B30B 15/14; B30B 15/16; B05C 11/02; B05C 1/00

[52] U.S. Cl. ..... 118/665; 100/47; 118/114; 118/116; 118/117; 118/249; 427/365; 427/428

[58] Field of Search ..... 100/47; 118/114, 115, 118/116, 117, 665, 249; 427/365, 428

[56] References Cited

U.S. PATENT DOCUMENTS

| | | | |
|---|---|---|---|
| 2,086,117 | 6/1937 | Case . | |
| 2,105,488 | 1/1938 | Massey et al. | |
| 2,459,091 | 1/1949 | Page . | |
| 2,681,636 | 6/1954 | Fridolph . | |
| 2,750,986 | 6/1956 | Russell et al. | |
| 2,881,731 | 4/1959 | Black et al. | |
| 2,900,951 | 8/1959 | Kabelitz . | |
| 3,600,747 | 8/1971 | McCarty | 100/47 X |
| 3,605,687 | 9/1971 | Russell . | |
| 3,777,656 | 12/1973 | Muller | 100/47 |
| 3,885,465 | 5/1975 | Bergendahl | 100/47 |
| 3,942,434 | 3/1976 | Wenzel et al. | 100/47 X |
| 4,029,833 | 6/1977 | Kosta . | |
| 4,117,054 | 9/1978 | Salo | 100/47 X |

FOREIGN PATENT DOCUMENTS 375255 9/1970 U.S.S.R.

*Primary Examiner*—Michael R. Lusignan
*Attorney, Agent, or Firm*—Dunlap, Codding & McCarthy

[57] ABSTRACT

A method and apparatus for positioning a wedge in a web coating machine utilizes hydraulic actuating cylinders for moving the wedge and a multicylinder constant displacement pump for operating the hydraulic actuating cylinder. Valve circuits are provided to transmit trains of pulses generated by the pump to a selected port of the hydraulic actuating cylinder and a valve circuit is provided to select the cylinders of the pump utilized to operate the hydraulic actuating cylinder. Each cylinder of the pump generates volumetrically metered pulse trains of pressurized hydraulic fluid and the valve circuits transmit selected numbers of pulses from selected pulse trains to the hydraulic actuating cylinder for a time period equal to a multiple of the cycle time of the pump.

5 Claims, 3 Drawing Figures

APPARATUS FOR POSITIONING A COATING THICKNESS CONTROL ROLLER IN A WEB COATING MACHINE

1. Field of the Invention

The present invention relates generally to machines for applying a coating to a moving web and, more particularly, but not by way of limitation, to mechanisms utilized to control the thickness of the coating.

2. Description of the Prior Art

The manufacture of many common articles involves the application of a thin coating to a moving web as a step in the production of the article. For example, an adhesive tape is formed by applying a coating of a suitable adhesive to a web of a suitable backing material as the web passes through a machine designed for the purpose of applying the coating. The article will have an end use and this end use will dictate both a nominal thickness for the coating and a tolerance to which this nominal thickness must be maintained. Thus, for example, the manufacture of a particular product might call for a coating thickness of ten thousandths of an inch to be maintained within ten percent; that is, to one thousandth of an inch. In such a case a web on which the coating has a thickness in the range from nine thousandths of an inch to eleven thousandths of an inch is within specifications imposed by the use to which the end product is to be put while a web, or portions thereof, for which the coating thickness lies outside this range does not meet specifications and must be rejected.

The control of the thickness of the coating applied to a web involves two basic operations. The thickness must be monitored and, at such times that the thickness departs from the allowable tolerance range, the machine which is applying the coating must be adjusted to return the coating to the required range. The devices for monitoring the thickness of a coating on a moving web are well known for example, it is common practice to use gauges which have a low level radiation source on one side of the web and a detector on the other side of the web, to measure the absorption of radiation by the web and by the coating. The amount of radiation absorbed then specifies, for a given coating material, for a given web material and for a given thickness of the web, the thickness of the coating on the web. Electronic equipment is also available for presenting the results of a monitoring operation in substantially any form which might be suitable for accomplishing the adjustment operation.

The adjustment of the coating thickness is usually effectuated by metering coating material through a metering gap formed by two adjacent members and adjusting the thickness of the gap. Thus, in one common type of machine, a roller which picks up a coating material from a reservoir is disposed substantially parallel to a roller which positions the moving web and the spacing between the rollers can be adjusted to adjust the thickness of the coating applied to the web. Either roller can be positioned for the purpose of adjusting the spacing. Similarly doctor knives can be utilized to form a metering gap with a roller and the doctor knife can be positioned to adjust the width of such gap. While many schemes employing rollers, knives and the like to control the thickness of the coating are known, the scheme briefly described above illustrates the general characteristics of these schemes. Machines utilized to apply a coating to a moving web will have at least one coating thickness control member which is supported at its ends so that the coating thickness control member can be moved on the frame of the machine to effectuate the adjustment of the metering gap. Because of the small distances through which the ends of the coating thickness control member must be moved it is common to support each end of the coating thickness control member with a device for producing a small variation in the metering gap for a relatively large movement of the mechanism which causes the variation. For example, it is common to use wedges to support the ends of the coating thickness control member and to move the wedges to position the ends of the coating thickness control member.

Problems have arisen in carrying this mode of positioning of the coating thickness control member into practice. For example, where the coating thickness control member is a roller supported by wedges, strong loading forces must be utilized to maintain firm engagement between bearing blocks which support the ends of the roller and the wedges and these loading forces, as well as the weight of the roller, require that substantial forces be exerted on the wedges to position the roller. In the past, where coating thickness tolerances are small, the cost of mechanisms to position the wedges has often been excessive. In particular, it has been common practice to utilize Acme screws to position the wedges and, because of the magnitudes of the forces, large diameter and, accordingly, expensive screws have been used. Moreover, considerable expense has also been incurred in providing mechanisms to actuate such screws for short times appropriate to a particular adjustment and to eliminate backlash when the direction of movement of a wedge is reversed.

SUMMARY OF THE INVENTION

The present invention solves these problems by positioning the ends of the coating thickness control member in a web coating machine by means of hydraulic actuating cylinders which are actuated by a source of pressurized hydraulic fluid which provides one or more trains of volumetrically metered pulses of hydraulic fluid. The pulses in each train are produced at periodic intervals and the positioning of the ends of the coating thickness control member is effected by transmitting one or more trains to a hydraulic actuating cylinder for a selected interval of time so that metered volumes of hydraulic fluid are introduced into the actuating cylinders to effect the adjustment of the position of a coating thickness control member.

A number of advantages are available by such mode of positioning the coating thickness control member. Specifically, the effects that distortion of materials under a load can have on accurate positioning of, for example, wedges, effects which have necessitated large and expensive screws in screw adjustment mechanisms used in the past, are inexpensively eliminated in the present invention. Hydraulic actuating cylinders are available in many sizes so that compression of the piston rods thereof can be made negligible for a specific application in which a web is coated. Moreover, the bore of a hydraulic actuating cylinder utilized to position the coating thickness control member can be selected to maintain the pressure in the hydraulic fluid utilized to operate the cylinder at a low value so as to make negligible any effect that compression of the hydraulic fluid might have on the positioning of the coating thickness control member. Thus, control can be achieved by selecting the quantity of hydraulic fluid delivered to the cylinder and, where such quantity is accurately metered, the coating thickness control member will be accurately positioned.

Moreover, adjustments are rapidly and easily controlled in the present invention. Specifically, the present invention exploits the ready availability of constant displacement pumps which provide trains of volumetrically metered pulses as described above, rapidly actuable valves and circuits which can convert a coating thickness deviation to a control signal applied to a control line for a time proportional to the deviation. In the present invention, such time intervals are established in increments of a whole multiple of the period of the hydraulic fluid pulses and the signals are applied to valves disposed between the pump and the hydraulic actuating cylinders. Since the distance an end of the coating thickness control member is moved by a hydraulic actuating cylinder is made proportional to the volume of fluid introduced into the hydraulic actuating cylinder, such positioning permits precise control of the thickness of the coating in a time period which is adjustable by adjusting the rate at which the pump is operated.

Another advantage of the present invention is that rapid rates of adjustment of the position of the coating thickness control member can be achieved at such times that a large deviation from the nominal thickness of the coating on the web and the actual thickness exists without sacrificing the accuracy required for a small adjustment of the thickness of the coating on the web. Constant displacement pumps are available with a number of cylinders so that such pumps will provide more than one train of periodic, volumetrically metered pulses of hydraulic fluid. In the present invention, valve assemblies utilized for transmitting hydraulic fluid from the pump to the hydraulic actuating cylinders which position the coating thickness control member provide a capability of transmitting one train of pulses to a hydraulic actuating cylinder or of transmitting a plurality of trains of pulses, each generated by one cylinder of a constant displacement pump, to the hydraulic actuating cylinder. Thus, the capability of transmitting only one train of pulses provides for accurate control of the adjustment in position of the coating thickness control member where only a small adjustment in such position is required and the capability of transmitting a plurality of trains of pulses to a hydraulic actuating cylinder provides a rapid adjustment rate at such times that a large adjustment of the position of the coating thickness control member is required.

An object of the present invention is to eliminate inaccuracies in the adjustment of a coating applied to a moving web arising from mechanical distortion of devices utilized to effectuate such adjustment.

Another object of the present invention is to provide an apparatus for positioning a coating thickness control member of a web coating machine with a capability for adjusting the position of such coating thickness control member at varying rates.

Yet a further object of the present invention is to provide an apparatus for positioning a coating thickness control member in a web coating machine with a variable adjustment rate capability without sacrificing the accuracy of control at such times that only a small adjustment is required.

Still another object of the present invention is to provide a relatively inexpensive apparatus for positioning a coating thickness control member in a web coating machine which is capable of making accurate adjustments of such position.

Other objects, advantages and features of the present invention will become clear from the following detailed description of the preferred embodiments of the invention when read in conjunction with the drawings and appended claims.

Figure 1:
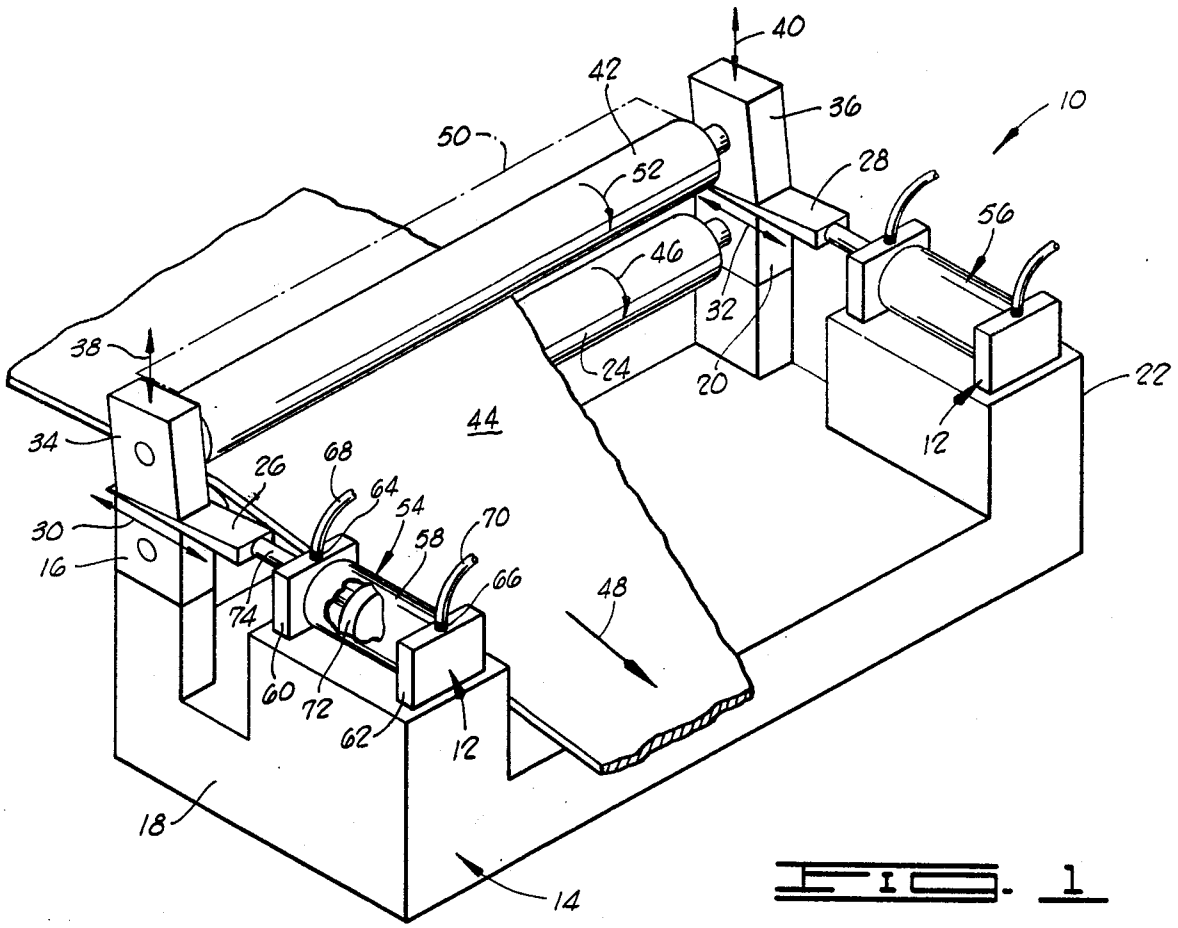
FIG. 1 is an isometric view of a schematic representation of one type of web coating machine incorporating a hydraulic coater actuator constructed in accordance with the present invention.
Figure 2:
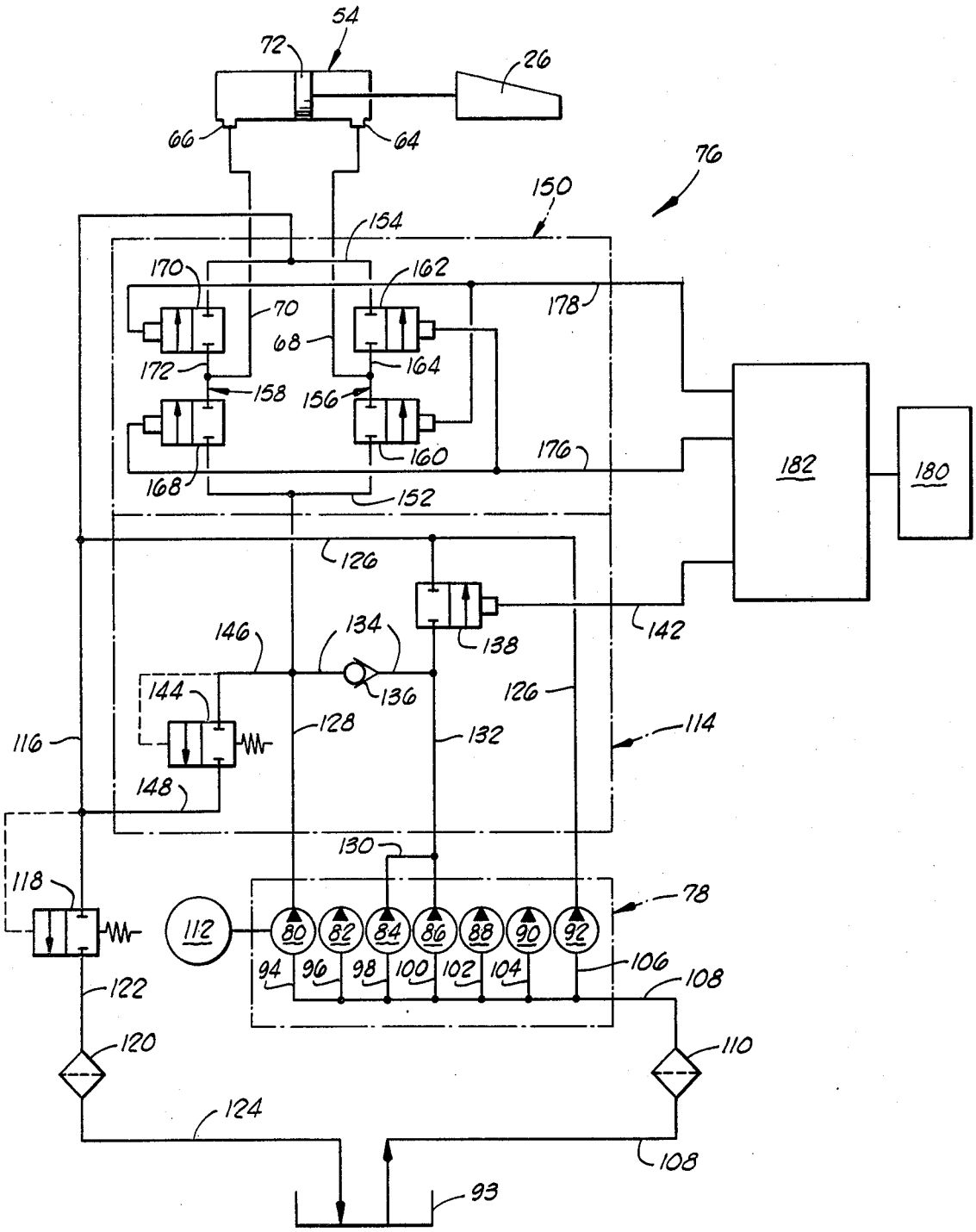
FIG. 2 is a schematic diagram of a portion of the hydraulic valve circuit of the hydraulic coater actuator.

DESCRIPTION OF FIGS. 1 and 2

Referring now to the drawings in general and to FIG. 1 in particular, shown therein and designated by the general reference numeral 10 is a schematic representation of one type of web coating machine incorporating a hydraulic coater actuator 12 constructed in accordance with the present invention. In general, the web coating machine 10 includes a frame 14 having a first fixed bearing block 16 mounted on a first side 18 of the frame 14 and a second fixed bearing block 20 mounted on a second side 22 of the frame 14 opposite the first fixed bearing block 16. A roller 24 is mounted on the frame 14 via the bearing blocks 16, 20 and extends transversely across the frame 14.

The machine 10 comprises first and second wedges 26 and 28, respectively, which are slidably supported by the fixed bearing blocks 16 and 20, respectively, for movement along lines 30 and 32, respectively, which are transverse to the roller 24. The wedges 26, 28, in turn, support first and second movable bearing blocks 34 and 36, respectively. Suitable guides (not shown) are provided for the movable bearing blocks 34, 36 and the guides support the movable bearing blocks 34, 36 for sliding movement along lines 38 and 40, respectively, which are substantially transverse to the lines 30, 32 along which the wedges 26, 28 slide and which are substantially transverse to the roller 24. Thus, the movable bearing blocks 34 and 36 can be raised and lowered relative to the fixed bearing blocks 16 and 20, respectively, by moving the first wedge 26 along the line 30 so as to adjust the spacing between the bearing blocks 16 and 34 and by moving the second wedge 28 along the line 32 so as to adjust the spacing between the bearing blocks 20 and 36.

The movable bearing blocks 34 and 36 support the ends of a roller 42 which serves as a coating thickness control member in the web coating machine 10. The roller 42 extends transversely across the frame 14 substantially parallel to the roller 24 and a web 44, to which a coating is to be applied by the machine 10, passes between the rollers 24 and 42. The web 44 is supported by the roller 24 which rotates in the direction indicated by the directional arrow numerically designated 46 in FIG. 1 so that the web 44 moves in the direction indicated by the directional arrow numerically designed 48 in FIG. 1. A suitable reservoir, indicated in phantom lines in FIG. 1 and designated therein by the numeral 50, contains the coating material to be applied to the web 44. The coating thickness control roller 42 rotates in the direction indicated by the directional arrow designated 52 in FIG. 1 and contacts the coating material so that a thin layer of coating material is constantly applied to the surface of the roller 42. As the web 44 passes between the rollers 24 and 42, the surface of the web 44 engages the layer of coating material on the roller 42 so that a layer of the coating material is transferred from the roller 42 to the web 44. The thickness of this coating is adjusted via positioning the wedges 26 and 28 so as to adjust the spacing between the surface of the roller 42 and the surface of the web 44.

It will be recognized from the discussion of the hydraulic coater actuator 12 to follow that the machine 10 is only one type of machine wherein the hydraulic coater actuator 12 can be advantageously employed. That is, the description of the machine 10 has been provided for purposes of clarity of disclosure and understanding of functioning of the hydraulic coater actuator 12. However, it is not intended to limit the present invention to utilization with machines such as the machine 10. Rather, for the practice of the present invention, it will suffice that a machine for applying a coating to a moving web have a coating thickness control member whose ends are positionable on the frame of a web coating machine and which is used for the control of the thickness of a coating applied to the web.

The hydraulic coater actuator 12 comprises a first hydraulic actuating cylinder 54 and a second hydraulic actuating cylinder 56 and the hydraulic actuating cylinders 54 and 56 are mechanically linked to the coating thickness control member. Thus, for example, when the hydraulic actuating cylinders utilized with a web coating machine such as the machine 10, the hydraulic actuating cylinders are mounted on opposite sides of the frame 14 for moving the wedges 26 and 28, respectively, along the lines 30 and 32. The hydraulic actuating cylinders 54 and 56 are identical and are connected between the frame 14 and the wedges 26 and 28 in an identical fashion so that it will not be necessary for purposes of the present disclosure to provide a detailed discussion of each of the hydraulic actuating cylinders 54 and 56 and the manner wherein the hydraulic actuating cylinders 54 and 56 are disposed between the frame 14 and the wedges 26 and 28. Rather it will suffice to note the identity of the hydraulic actuating cylinders 54 and 56 and the manner in which they are disposed between the frame 14 and the wedges 26 and 28 and to provide a detailed description of the hydraulic actuating cylinder 54 and the connection thereof between the frame 14 and the wedge 26. The first hydraulic actuating cylinder 54 comprises a bored cylinder 58 which is closed at each end by heads 60 and 62. The heads 60 and 62 are provided with ports 64 and 66, respectively, which communicate with the interior of the bored cylinder 58 so that hydraulic fluid can be introduced into either end of the bored cylinder 58 or drained therefrom via the ports 64 and 66. Hydraulic conduits 68 and 70 are connected to the ports 64 and 66, respectively, for this purpose. The bored cylinder 58 contains a piston 72 which moves axially along the bored cylinder 58 in response to the introduction of hydraulic fluid into one of the ports 64, 66 and the draining of hydraulic fluid from the other of the ports 64, 66 in the usual manner. A piston rod 74 is attached to one side of the piston 72 and extends through a suitable gland (not shown) in the head 60. The hydraulic actuating cylinder 54 is mounted on the frame 14 of the web coating machine 10, via the heads 60, 62, and is positioned on the frame 14 such that the piston rod 74 is disposed along the line 30 along which the first wedge 26 moves to position the first movable bearing block 34. The end of the piston rod 74 exterior of the bored cylinder 58 is connected to the large end of the first wedge 26 and can be moved along the line 30 via the introduction of hydraulic fluid into the bored cylinder 58 through one of the ports 64, 66 while hydraulic fluid is drained from the bored cylinder 58 through the other of the ports 64, 66.

The hydraulic coater actuator 12 comprises a first hydraulic valve circuit to operate the first hydraulic actuating cylinder 54 and an identical second hydraulic valve circuit to operate the second hydraulic cylinder 56 so that the hydraulic valve circuits provide a means for moving the wedges 26 and 28 to position the roller 42 relative to the roller 24 whereby control of the thickness of the coating on the web is achieved. FIG. 2, which shows a schematic circuit diagram for the first hydraulic valve circuit, designated by the reference numeral 76, has been provided to show the construction and operation of the hydraulic valve circuits. The second hydraulic valve circuit is identical to the first hydraulic valve circuit 76 and need not be discussed for purposes of the present disclosure.

The hydraulic coater actuator 12 further comprises a pump, schematically indicated at 78 in FIG. 2, for supplying pressurized hydraulic fluid to the hydraulic actuating cylinders 54, 56 via the hydraulic valve circuits. In the practice of the present invention, the pump 78 is selected to be a constant displacement pump and is preferably a multicylinder constant displacement pump such as the Racine Model 20H available from Hydraulics Components Division of Rexnord, Inc., Racine, Wisconsin. This pump has seven cylinders and FIG. 2 has been drawn for the case wherein a seven cylinder pump is utilized for the pump 78 and the cylinders of the pump 78 have been designated by the numerals 80-92 in FIG. 2.

The present invention exploits the characteristics of pumps of this type so that it is necessary for an understanding of the present invention to briefly discuss these characteristics. The cylinders 80-92 of the pump 78 are connected to a hydraulic fluid sump 93 via internal connections 94-106, respectively, and a hydraulic conduit 108. A suitable filter 110 can be disposed in the conduit 108 as has been shown in FIG. 2. When the pump 78 is driven by a motor, schematically indicated at 112 in FIG. 2, each cylinder thereof draws hydraulic fluid from the sump 93 and discharges such fluid as a train of volumetrically metered pulses. In particular, the volume of the fluid discharged from each cylinder as a function of time generally has the form of a half-wave rectified sine wave so that each pulse is delivered over a time interval of substantially one half of the cycle period of the pump 78 and consecutive pulses are separated in time by one half such period. Moreover, the volume of fluid delivered in each pulse is determined by the construction of the pump 78 so that each pulse in a pulse train discharged by a cylinder of the pump 78 has specific volume. Thus, for each pulse delivered to one of the actuating cylinders 54, 56, the wedge 26, 28 connected thereto will be shifted a specific distance so that the end of the roller 42 supported by such wedge 26, 28 will be raised or lowered a specific distance by the delivery of the pulse to the actuating cylinder. Moreover, since each cylinder of the pump 78 produces one pulse in one cycle of operation of the pump 78, such specific distance of shift for one end of the roller 42 corresponds to the cycle time of the pump 78. The present invention utilizes the relationship between the cycle time of the pump 78 and a specific shift distance for one end of the roller 42 in a manner to be discussed below. It is also noted that the pressure at which hydraulic fluid is delivered by pumps of this type is variable; that is, each cylinder of the pump 78 exerts a sufficient force on fluid discharged thereby to meet the requirements of the hydraulic circuit to which the cylinder is connected.

The first hydraulic valve circuit 76 comprises a first speed control valve circuit 114 which is connected to three of the cylinders 80-92 of the pump 78 so that the speed control valve circuit 114 receives three pulse trains from the pump 78. The second hydraulic valve circuit (not shown) similarly comprises a second speed control valve circuit, identical to the first speed control valve circuit 114, which is similarly connected to the three of the remaining cylinders 80-92 of the pump 78. For purposes of dynamic balancing of the pump 78, it is useful to intersperse the cylinders to which the first speed control valve circuit 114 is connected with the cylinders to which the second speed control valve circuit is connected where the cylinders of the pump 78 are arranged radially in a circle about a central drive shaft as is the case for the Racine Model 20H pump and such interspersing has been indicated in FIG. 2. Thus, in FIG. 2, the cylinders 80-92 have been drawn in a line corresponding to the consecutive angular displacement of the cylinders 80-92 about the drive shaft for the pump 78, at such times that the pump 78 is constructed in the manner of the Racine Model 20H, and the first speed control valve circuit 114 is connected to the first, third and fourth cylinders with respect to such consecutive displacement of the cylinders about the drive shaft of the pump 78. Similarly, the second speed control valve circuit (not shown) can conveniently be connected to the second, fifth and sixth cylinders of the pump 78. Where a pump selected for use in the hydraulic coater actuator 12 has more than six cylinders, it is convenient to return the output of one cylinder to the sump 93 as has been indicated for the cylinder 92 in FIG. 2. Specifically, the hydraulic fluid is returned to the sump 93 via a return conduit 116, a pressure relief valve 118, a filter 120, and conduits 122 and 124 connecting the pressure relief valve to the filter 120 and the filter 120 to the sump 93, respectively, and it is convenient to connect the output of the cylinder 92 to the return conduit 116 via a suitable hydraulic conduit 126. The pressure relief valve 118 is utilized to maintain pressure on seals of components of the hydraulic valve circuits and is set to transmit hydraulic fluid from the return conduit 116 to the conduit 122 at such times that the pressure differential across the valve 118 exceeds a preselected value.

The first speed control valve circuit 114 has a primary hydraulic conduit 128 which is connected to the cylinder 80 of the pump 78 so as to receive the hydraulic fluid pulse train discharged by such cylinder 80. The cylinders 84 and 86 of the pump 78 are connected to the primary hydraulic conduit 128 via conduits 130, 132 and 134 and a check valve 136 is interposed in the conduit 134 to permit hydraulic fluid to pass therethrough only in a direction toward the primary hydraulic conduit 128. A solenoid actuated, normally closed, two-way hydraulic valve 138 is connected between the conduit 132 and the conduit 126, which is connected to the return conduit 116, so as to divert the pulse trains generated in the cylinders 84 and 86 of the pump 78 to the return conduit 116 at such times that the check valve 136 is closed and the valve 138 is opened. The valve 138 is opened by electrical signals supplied to the solenoid thereof as will be discussed below and a signal path to transmit the electrical signals has been schematically indicated at 142 in FIG. 2.

The first speed control valve circuit 114 further comprises a pressure relief valve 144 which is connected between the primary hydraulic conduit 128 and the return conduit 116 via conduits 146 and 148. For a purpose to be discussed below, the pressure relief valve 144 is set to transmit hydraulic fluid from the primary hydraulic conduit 128 to the return conduit 116 when the pressure at the input port thereof is greater than the sum of the pressure required to open the pressure relief valve 118 and the pressure required to be delivered to the first actuating cylinder 54 to shift the position of the first wedge 26.

The first hydraulic valve circuit 76 further comprises a first direction control valve circuit 150 which is interposed between the primary hydraulic conduit 128 and the return conduit 116 and which is connected to the first hydraulic cylinder 54 to supply pulse trains introduced into the primary hydraulic conduit 128 to the first hydraulic actuating cylinder 54. (The second hydraulic valve circuit, not shown, similarly includes a second direction control valve circuit, which is identical to the first direction control valve circuit 150, to operate the second hydraulic actuating cylinder 56.) The direction control valve circuits are bridge circuits as has been shown in FIG. 2 for the first direction control valve circuit 150. Specifically, the first direction control valve circuit comprises: an input conduit 152 connected to the primary hydraulic conduit 128; a discharge conduit 154 connected to the return conduit 116; a first bridge arm 156 connected between the input conduit 152 and the discharge conduit 154 and a second bridge arm 158 similarly connected between the input conduit 152 and the discharge conduit 154 in parallel with the first bridge arm 156.

The first bridge arm 156 comprises two solenoid actuated, normally closed, two-way hydraulic valves 160 and 162 which are connected in series between the input conduit 152 and the discharge conduit 158 via a conduit 164. The conduit 68 connects the conduit 164 to the port 64 of the first hydraulic actuating cylinder 54. Similarly, the second bridge arm 158 comprises two solenoid actuated normally closed, two-way hydraulic valves 168 and 170 connected in series between the input conduit 152 and discharge conduit 154 via a conduit 172. The conduit 70 connects the conduit 172 to the other port 66 of the hydraulic actuating cylinder 54. The valves 160, 162, 168 and 170 can be opened by electrical signals supplied to the solenoids thereof and signal paths for transmitting electrical signals to the solenoids of the valves 160, 162, 168 and 170 have been schematically indicated in FIG. 2. In particular, the valve 168, disposed in the second bridge arm 158 and connected to the input conduit 152, and the valve 162, disposed in the first bridge arm 156 and connected to the discharge conduit 154, are opened by signals supplied on a signal path schematically indicated at 176 in FIG. 2. The valve 160, disposed in the first bridge arm 156 and connected to the input conduit 152, and the valve 170, disposed in the second bridge arm 158 and connected to the discharge conduit 154, are opened by electrical signals supplied on a signal path schematically indicated at 178 in FIG. 2.

OPERATION OF FIGS. 1 AND 2

It is contemplated that the hydraulic coater actuator 12 will be used in conjunction with a suitable coating thickness monitoring device and associated control circuitry for translating the output of such device into control signals supplied to the hydraulic coater actuator 12 and such device and associated circuitry have been schematically indicated in FIG. 2 at 180 and 182, respectively. The device 180 and the control circuitry 182 can take any of many known forms; for example, the device 180 can be a radiation gauge and the circuitry 182 can be an appropriately programmed general purpose digital computer. Moreover, the control circuitry 182 provides control signals to the second hydraulic valve circuit (not shown) in the same manner that the circuitry 182 provides control signals to the first hydraulic valve circuit 76. Accordingly, it will suffice for purposes of explaining the operation of the hydraulic coater actuator 12 to describe the nature of control signals applied to the first hydraulic valve circuit 76 and the manner in which the control signals are related to measurements of thickness of the coating applied to the web 44.

The end use of the web 44 will specify both a nominal thickness for a coating applied thereto and a tolerance to which such thickness must be controlled. In the present invention, such tolerance is utilized to digitize the operation of the hydraulic coater actuator 12 as will now be explained. The device 180 and the associated circuitry 182 are constructed to measure the deviation of the thickness of a coating applied to the web 44, from the nominal thickness, in increments of the allowed tolerance and to supply control signals on the signal paths 142, 176 and 178 (and corresponding signal paths for the second hydraulic control circuit) in time increments corresponding to such tolerance increments. These time and tolerance increments are, in turn, related to the cycle period of the pump 78 and the distances through which the wedge 26 will move in response to the introduction into the hydraulic actuating cylinder 54, on one side of the piston 72 thereof, of an amount of fluid equal to the volume of one pulse discharged by one cylinder of the pump 78 in one cycle of operation of the pump 78. Specifically, the hydraulic actuating cylinder 54 and the pump 78 are chosen such that the wedge 26 will move one end of the roller 42 through a distance equal to one tolerance increment when a selected number of pulses are introduced into the hydraulic actuating cylinder 54. (It will be noted that the displacement of the wedge 26 when a specific volume of fluid is introduced into the hydraulic actuating cylinder 54 on one side of the piston 72 differs from the displacements of the wedge 26 where, as has been indicated in the drawings, the hydraulic actuating cylinder 54 has only one piston rod. That is, the volume of fluid which must be introduced in the port 66 to move the wedge 26 a specific distance toward the first movable bearing block 34 is equal to the product of the area of the piston 72 and the specific distance through which the wedge 26 is to be moved while the volume of fluid which must be introduced into the port 64 to move the wedge 26 a specific distance away from the first movable bearing block 34 is the product of such specific distance and the difference between the area of the piston 72 and the cross-sectional area of the piston rod 74. In many applications, the number of pulses corresponding to one tolerance increment can be selected on the basis of the area of the piston alone and the effect of the piston rod on the distance the wedge moves at such times that hydraulic fluid is introduced into the port 64 can be neglected. Where such is not the case, hydraulic actuating cylinders having pistons extending from both sides of the piston through glands in both heads can be utilized in place of the single piston hydraulic actuating cylinders 54, 56 shown in the drawings.) The time increments in which control signals are supplied by the circuitry 182 are then made equal to the time required for the pump 78 to execute a number of operating cycles equal to the number of pulses selected to move an end of the roller 42 through one tolerance increment. At such times that a correction is made to the position of the wedge 26, electrical signals are supplied to selected ones of the signal paths 142, 176 and 178 for time periods equal to a selected number of time increments by conventional gating and timing circuits in the electronic circuitry 182.

It will be useful for purposes of discussing the operation of the hydraulic coater actuator to consider the operation of the hydraulic valve circuit 76 for three cases: (1) the operation at such times that the thickness of the coating on the web 44 is within a tolerance increment of the nominal thickness; (2) the operation at such times that the thickness of the coating on the web 44 varies from the nominal thickness by a small number of tolerance increments; and (3) the operation at such times that the thickness of the coating on the web 44 varies from the nominal thickness by a relatively large number of tolerance increments. When the thickness of the coating on the web 44 is within a tolerance increment of the nominal thickness, such fact will be measured by the monitoring device 180 and transmitted to the electronic circuitry 182 which will respond by impressing no electrical signals on the signal paths 142, 176 or 178. Since no electrical signal appears on the signal path 142, the valve 138 will be closed to isolate the cylinders 84 and 86 of the pump 78 from the conduit 126 by means of which fluid discharged from the cylinders 84 and 86 can be transmitted to the return conduit 116. Accordingly, the cylinders 84 and 86 will discharge the trains of pulses generated thereby at a pressure sufficient to overcome the pressure in the primary hydraulic conduit 128 so as to open the check valve 136 and transmit the pulses generated by the cylinders 84 and 86 to the primary hydraulic conduit 128. Since no electrical signals appear on the signal paths 176, 178, the valves 160 and 168 will be closed to isolate the primary hydraulic conduit 128 from the hydraulic actuating cylinder 54. Accordingly, as hydraulic fluid is discharged into the primary hydraulic conduit 128 from the cylinders 80, 84 and 86 of the pump 78, the pressure in the primary hydraulic conduit 128 will build to a point sufficient to open the relief valve 144 and all fluid introduced into the primary hydraulic conduit 128 from the cylinders 80, 84 and 86 will be discharged into the return conduit 116 and returned to the sump 93.

At such times that the thickness of the coating on the web 44 near the end of the roller 42 supported by the wedge 26 varies from the nominal thickness by a relatively small number of tolerance increments, such fact and the direction in which the wedge 26 must be moved to bring the thickness at such portion of the web 44 within one tolerance increment of the nominal thickness will be measured by the monitoring device 180 and transmitted to the associated electronic circuitry 182. In response, the circuitry 182 will impress an electrical signal on the signal path 142 and on one of the signal paths 176 and 178. In particular, where the coating thickness exceeds the nominal thickness, an electrical signal is impressed upon the signal path 178 to open valves 160 and 170. Where the coating thickness is less than the nominal thickness, an electrical signal will be impressed upon the signal path 176 to open valves 162 and 168. Considering first that an electrical signal is impressed upon the signal path 178, it will be clear from FIG. 2 that a path for pulse trains introduced into the primary hydraulic conduit 128 will be opened therefrom to the port 64 via the valve 160 and the conduits 164 and 68. Simultaneously, a path for transmission of fluid from the port 66 to the return conduit 116 will be opened via the conduits 70 and 172, the valve 170 and the return conduit 154. Thus, pulse trains introduced into the primary hydraulic conduit 128 can be discharged therefrom either into the hydraulic actuating cylinder 54, to move the wedge 26 away from the first movable bearing block 32 to lower the end of the roller 42 supported by the first movable bearing block 34, or such pulses can be discharged through the relief valve 144 to the return conduit 116. Since the relief valve 144 is set to transmit hydraulic fluid only at such times that the pressure in the primary hydraulic conduit 128 exceeds the pressure required to adjust the hydraulic actuating cylinder 54, the relief valve 144 will remain closed and pulses introduced into the primary hydraulic conduit 128 will be transmitted to the hydraulic actuating cylinder 54 to adjust the position of the wedge 26.

The number of pulses transmitted to the hydraulic actuating cylinder 54 will be equal to the number of pulses discharged into the primary hydraulic conduit 128 by the cylinder 80 during the time for which the electrical signal is impressed upon the signal path 178. In particular, the appearance of an electrical signal on the path 142 will open the valve 138 so that pulses generated by the cylinders 84 and 86 of the pump 78 will be transmitted through the valve 138 and the conduit 126 to the return line 116. The construction of the electronic circuitry 182 to impress signals on selected ones of the signal paths 142, 176 and 178 in time increments as has been described above will now become apparent. For each time increment during which an electrical signal is impressed upon the signal path 178, a number of pulses will be generated in the cylinder 80 sufficient to move the wedge 26 a distance required to lower the end of the roller 42 supported by the first movable bearing block 34 a distance of one tolerance increment. Thus, the electrical signal will be impressed upon the signal path 178 for a number of time increments equal to the number of tolerance increments for which such end of the roller 42 must be lowered. The operation of the hydraulic coater actuator 12 at such times that the end of the roller 42 supported by the first movable bearing block 34 must be raised by a small number of tolerance increments differs from the case wherein such end of the roller 42 must be lowered only in that the electrical signal is impressed upon the signal path 176 so that the pulses introduced into the primary hydraulic conduit 128 are transmitted to the port 66 via the valve 168 and the conduits 172 and 70 while hydraulic fluid is drained from the port 64 into the return conduit 116 via the conduits 164 and 68, the valve 162 and the discharge conduit 154.

At such times that a large correction must be made to the position of the end of the roller 42 supported by the first movable bearing block 34, the electronic circuitry 182 impresses an electrical signal only on the signal path, 176 or 178, appropriate to the direction in which the wedge 26 must be moved. Since no electrical signal is impressed upon the signal path 142, the valve 138 remains closed and three pulse trains, from the cylinders 80, 84 and 86 of the pump 78, are introduced into the primary hydraulic conduit 128 for transmission via the direction control valve circuit 150 to the hydraulic actuating cylinder 54. By this means, thrice the volume of fluid will be introduced into the hydraulic actuating cylinder 54 for each time increment wherein an electrical signal is impressed upon the appropriate signal path 176 or 178 than will be the case wherein an electrical signal is also impressed upon the signal path 142 so that adjustment to the position of the wedge 26 is carried out in the same manner as described above but in substantially one third the time. Where a number of distance increments by which the end of the roller 42 supported by the wedge 26 must be adjusted is not an even multiple of three, the electronic circuitry 182 will impress an electrical signal on the signal path 142 to cause single pulse train adjustment of the hydraulic actuating cylinder 54 when the position of the end of the roller 42 supported by the wedge 26 has been brought to within one or two tolerance increments of the nominal value. That is, for a portion of the adjustment period, fluid discharged from cylinders 80, 84 and 86 will be utilized to adjust the position of the wedge 26 and for remaining portions of such period fluid from only the cylinder 80 of the pump 78 will be used for such purpose.

Signal paths form the circuitry 182 are provided to actuate solenoid valves in the second hydraulic valve circuit and such signal paths connect to valves in the second hydraulic valve circuit corresponding to the valves 138, 160, 162, 168 and 170. The end of the roller 42 supported by the wedge 28 is adjusted in the same manner that the end thereof supported by the wedge 26 is adjusted.

DESCRIPTION OF FIG. 3

Figure 3:
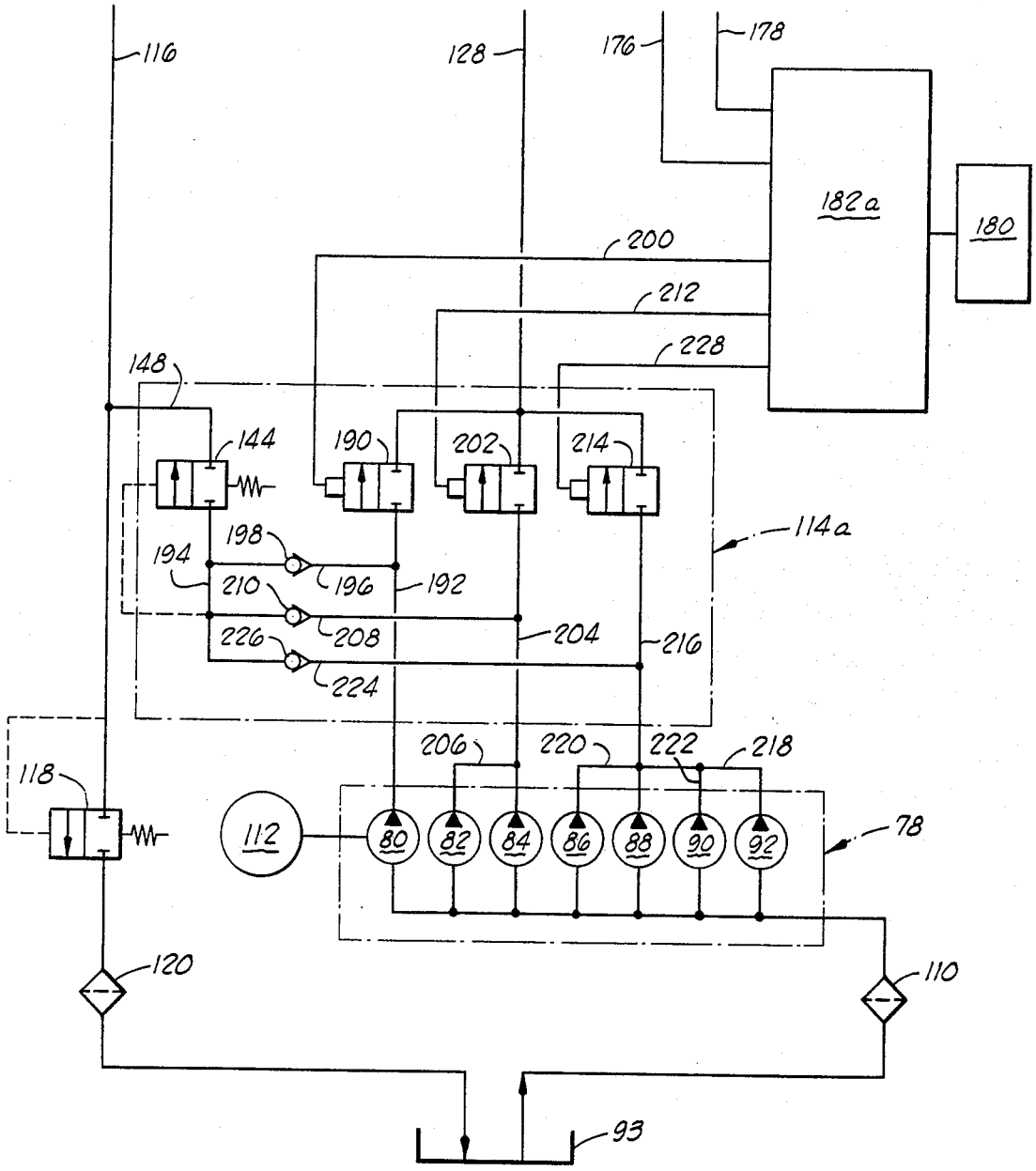
FIG. 3 is a schematic diagram of a modification of the speed control valve circuit of the hydraulic valve circuit of the hydraulic coater actuator.

In a number of applications, it is desirable that adjustments be made to the positions of the wedges 26, 28 and, accordingly, to the positions of the ends of the rollers 42 in as short a time as is feasable under the circumstances of the application. For example, such circumstances may dictate that the web 44 move at a high speed or that the monitoring device 180 be located a considerable distance from the frame 14 so that a considerable length of web which does not meet specifications and, accordingly, must be rejected, can be produced in the time required to make and verify the adjustment. FIG. 3 shows a modification of the first speed control valve circuit, designated **114*a* in FIG. 3, which is constructed to minimize the adjustment time for the wedge 26. A similarly modified second speed control valve circuit (not shown) will be provided for the wedge 28. As is shown in FIG. 3, all cylinders of the pump 78 are utilized to provide pulse trains of hydraulic fluid to the primary hydraulic conduit 128 of the first speed control valve circuit 114*a* so that a second pump (not shown) will be provided to provide pulse trains to the primary hydraulic conduit of the modified second speed control valve circuit utilized to adjust the position of the wedge 28**.

The primary hydraulic conduit 128 and return conduit 116 shown in FIG. 3 connect to the first direction control valve circuit 150 and, accordingly, provide hydraulic fluid to the first actuating cylinder 54 in the manner which has been described above. The electronic circuitry utilized with the modified first speed control valve circuit 114*a* impresses electrical signals on the signal paths 176 and 178 as has been described above but is modified to provide signals to the first speed control valve circuit 114*a* in a manner which will be described below.

In the first speed control valve circuit 114*a*, the cylinder 80 is connected to a solenoid actuated, normally closed, two-way hydraulic valve 190 via a hydraulic conduit 192 and to the inlet port of the relief valve 144 via conduits 194 and 196, the conduit 196 having interposed therein a check valve 198 to transmit hydraulic fluid to the relief valve 144 at such times that the valve 190 is closed. Since the relief valve 144 will establish the pressure in the hydraulic conduit 194, it will be clear that, at such times that the valve 190 is opened and the first direction control valve circuit 150 is actuated to transmit fluid to the hydraulic actuating cylinder 54, the check valve 198 will close so that pulses of hydraulic fluid generated by the cylinder 80 will be utilized to position the wedge 26 as described above. The valve 190 is actuated via an electrical signal supplied by electronic circuitry 182*a*, which is connected to the monitoring device 180, on a signal path 200. Similarly, the cylinders 82 and 84 of the pump 78 are connected to a solenoid actuated, normally closed, two-way hydraulic valve 202 via conduits 204 and 206 and the conduit 204 is connected to the conduit 194 via a conduit 208 containing a check valve 210 permitting fluid flow only from the conduit 204 to the conduit 194 which is connected to the relief valve 144. The valve 202 can be opened by the electronic circuitry 182*a* via an electrical signal impressed upon a signal path 212 connected to the solenoid of the valve 202. The cylinders 86-92 are connected to yet a third solenoid actuated, normally closed, two-way hydraulic valve 214 via conduits 216, 218, 220 and 222. The conduit 216 is connected to the conduit 194 which, in turn, is connected to the inlet port of the relief valve 144 via a conduit 224 containing a check valve 226 which permits the transmission of hydraulic fluid only from the conduit 216 to the relief valve 144. The valve 214 can be opened via an electrical signal supplied by the electronic circuitry 182*a* to the solenoid of the valve 214 on a signal path 228.

The operation of a hydraulic coater actuator including the modified first speed control valve circuit 114*a* differs from the operation of a hydraulic coater actuator including the speed control valve circuit 114 in that the speed control valve circuit 114*a* permits a wider selection of the number of pulse trains to be introduced into the primary hydraulic conduit 128 for transmission to the first hydraulic actuating cylinder 54 as will now be explained. At such times that the thickness of the coating on the web 44 at the side thereof adjacent the first movable bearing block 34 varies from the nominal thickness by more than one tolerance increment, such fact and the direction the wedge 26 must be moved to bring the thickness at such portion of the web 44 within one tolerance increment of the nominal thickness will be measured by the monitoring device 180 and transmitted to the associated electronic circuitry 182*a*. In response the electronic circuitry 182*a* will impress an electrical signal on the appropriate signal path 176, 178 to increase or decrease the thickness of the coating at such portion of the web 44 as described above and will impress electrical signals on a combination of the signal paths 200, 212 and 228. Where, as will often be the case, the required connection is no more than seven tolerance increments, the time for which the electrical signals are impressed upon the selected paths will equal one time increment corresponding to one tolerance increment and the combination of signal paths 200, 212, 228 upon which electrical signals are impressed will determine the correction made to the position of the wedge 26 and, accordingly, to the position of the end of the roller 42 supported thereby. Specifically, where one tolerance increment is required, an electrical signal is impressed only upon signal path 200 so that only the pulse train from the cylinder 80 of the pump 78 is transmitted, via the valve 190, to the primary hydraulic conduit 128 and, therefrom via the first direction control valve circuit 150, to the first hydraulic actuating cylinder 54. Where two tolerance increments are required, an electrical signal is impressed upon the signal path 212 to open valve 202 so as to provide two pulse trains, generated by cylinders 82 and 84 of the pump 78, to the primary hydraulic conduit 128. Where three tolerance increments are required, electrical signals are impressed upon signal paths 200 and 212 to open valves 190 and 202 so as to provide three pulse trains, from cylinders 80, 82 and 84 of pump 78, to the hydraulic conduit 128. Where four tolerance increments are required, an electrical signal is impressed upon signal path 228 to open valve 214 so as to provide pulse trains from cylinders 86, 88, 90 and 92 to the primary hydraulic conduit 128. Where five tolerance increments are required, electrical signals are impressed upon signal paths 200 and 228 to open valves 190 and 214 so as to provide pulse trains generated by cylinders 80, 86, 88, 90 and 92 to the primary hydraulic conduit 128. Where six tolerance increments are required, electrical signals are impressed upon signal paths 212 and 228 to open valves 202 and 214 so as to provide pulse trains generated by cylinders 82-92 to the primary hydraulic conduit 128. Finally, where seven tolerance increments are required, electrical signals are impressed upon all three signal paths 200, 212 and 228 to open all three valves 190, 202 and 214 so as to transmit pulse trains from all of the cylinders 80-92 of the pump 78 to the primary hydraulic conduit 128. Thus, any multiple up to seven of the number of pulses required to effect one tolerance increment adjustment of the end of the roller 42 supported by the wedge 26 can be supplied in one time increment to the primary hydraulic conduit 128 and such number of pulses is transmitted via the direction control valve circuit 150 to the hydraulic actuating cylinder 54 to adjust the position of the wedge 26 the required amount. Where more than seven tolerance increments are required to adjust the end of the roller 42 supported by the wedge 26, multiple time increments wherein electrical signals are supplied to selected ones of the signal paths 176, 178, 200, 212 and 228 can be utilized to effect the adjustment of such end of the roller 42. The end of the roller 42 supported by the wedge 28 is adjusted in an identical fashion.

It is clear that the present invention is well adapted to carry out the objects and attain the ends and advantages mentioned as well as those inherent therein. While presently preferred embodiments of the invention have been described for purposes of this disclosure, numerous changes may be made which will readily suggest themselves to those skilled in the art and which are encompassed within the spirit of the invention disclosed and as defined in the appended claims.

What is claimed is:

1. An apparatus for positioning one end of a coating thickness control member on the frame of a web coating machine, comprising:

a hydraulic actuating cylinder mounted on said frame and mechanically linked to said one end of the coating thickness control member so as to move said one end of the coating thickness control member in proportion to a volume of hydraulic fluid introduced into said hydraulic actuating cylinder;

pump means for generating at least one hydraulic fluid pulse train, each of said trains characterized as having the form of a series of volumetrically metered pulses of pressurized hydraulic fluid; and valve means actuable for transmitting selected pulse trains to the hydraulic actuating cylinder.

2. The apparatus of claim 1 wherein the valve means comprises:

direction control valve means for receiving the selected pulse trains and for selectively transmitting said pulse trains to one port of the hydraulic actuating cylinder so as to expand the hydraulic actuating cylinder and, alternatively, transmitting said pulses to one other port of the hydraulic actuating cylinder so as to contract the hydraulic actuating cylinder; and speed control means interposed between the direction control valve means and the pump means for transmitting the selected pulse trains to the direction control valve means.

3. The apparatus of claim 2 wherein the direction control valve means is characterized as being a hydraulic bridge circuit comprising:

a first bridge arm comprising two series connected, solenoid actuated, normally closed, two-way hydraulic valves; and a second bridge arm comprising two series connected, solenoid actuated, normally closed, two-way hydraulic valves;

wherein the bridge arms are parallel connected between an input conduit for the bridge conduit and a discharge conduit for the bridge conduit; and wherein one port of the hydraulic actuating cylinder is connected to the bridge circuit at a point between the hydraulic valves of the first bridge arm and the other port of the hydraulic actuating cylinder is connected to the bridge circuit at a point between the hydraulic valves of the second bridge arm.

4. The apparatus of claim 2 or claim 3 wherein the pump means is characterized as being a multi-cylinder constant displacement pump, each cylinder thereof generating one pressurized hydraulic fluid pulse train; and wherein the speed control valve means comprises:

a primary hydraulic conduit connected between one cylinder of said pump and the direction control valve means;

a pressure relief valve connected to the primary hydraulic conduit;

a check valve connected between the primary hydraulic conduit and a selected number of other cylinders of said pump so as to transmit pressurized hydraulic fluid to the primary hydraulic conduit in an open condition of said check valve; and a valve connected to the side of the check valve connected to the pump and actuable to divert pulse trains generated by said selected other cylinders of said pump from the check valve.

5. The apparatus of claim 2 or claim 3 wherein the pump means is characterized as being a multicylinder constant displacement pump and wherein the speed control valve means comprises:

a primary hydraulic conduit connected to the direction control valve means;

a plurality of solenoid actuated, normally closed, two-way hydraulic valves, each of such two-way hydraulic valves connected between the primary hydraulic conduit and at least one cylinder of the pump means;

a check valve for each of the two-way hydraulic valves of the speed control valve means, each check valve connected to the side of its associated two-way hydraulic valve which is connected to the pump means so as to transmit hydraulic fluid away from its associated two-way hydraulic valve in an open condition of the check valve; and a pressure relief valve, each check valve connecting the pressure relief valve to the two-way hydraulic valve for which the check valve is provided.

* * * * *